US008116488B2

(12) United States Patent
Nagasawa et al.

(10) Patent No.: US 8,116,488 B2
(45) Date of Patent: Feb. 14, 2012

(54) SOUND REPRODUCING APPARATUS AND VEHICLE USING THE SOUND REPRODUCING APPARATUS

(75) Inventors: Shinnosuke Nagasawa, Osaka (JP); Kazuhisa Kotegawa, Osaka (JP); Fumiyasu Konno, Osaka (JP)

(73) Assignee: Panasonic Corporation, Osaka (JP)

( * ) Notice: Subject to any disclaimer, the term of this patent is extended or adjusted under 35 U.S.C. 154(b) by 1157 days.

(21) Appl. No.: 11/911,282

(22) PCT Filed: Apr. 6, 2006

(86) PCT No.: PCT/JP2006/307311

§ 371 (c)(1), (2), (4) Date: Oct. 11, 2007

(87) PCT Pub. No.: WO2006/112267

PCT Pub. Date: Oct. 26, 2006

(65) Prior Publication Data

US 2009/0074212 A1 Mar. 19, 2009

(30) Foreign Application Priority Data

Apr. 14, 2005 (JP) ..... 2005-116844

(51) Int. Cl.
*H04R 5/02* (2006.01)

(52) U.S. Cl. ..... 381/302; 381/89; 381/86; 381/97

(58) Field of Classification Search ..... 381/302, 381/71.86, 97, 89
See application file for complete search history.

(56) References Cited

U.S. PATENT DOCUMENTS 4,769,843 A * 9/1988 Imai et al. ..... 381/302
(Continued)

FOREIGN PATENT DOCUMENTS

JP 59-6396 U 1/1984
(Continued)

OTHER PUBLICATIONS

English translation of Japanese Patent JP1-248800 A by Hayakawa et al. ( date Oct. 1989 ).*

(Continued)

*Primary Examiner* — Thinh T Nguyen
(74) *Attorney, Agent, or Firm* — RatnerPrestia

(57) ABSTRACT

The sound reproducing apparatus for use with a signal source comprises, a first output unit connected to the signal source via a first power amplifier, a first phase shifter connected to the signal source, a second output unit connected to the first phase shifter via a second power amplifier, a second phase shifter connected to the signal source, a third output unit connected to the second phase shifter via a third power amplifier, a fourth phase shifter connected to a third phase shifter, and a fourth output unit connected to the fourth phase shifter via a fourth power amplifier, wherein the first output unit and the second output unit are in right and left relation with each other, the third output unit and the fourth output unit are in right and left relation with each other, a group of the first output unit and the second output unit and a group of the third output unit and the fourth output unit are in front and rear relation with each other. The vehicle is equipped with the sound reproducing apparatus. In this way, it is possible to obtain a sound reproducing apparatus improved in sound quality and a vehicle using the sound reproducing apparatus.

4 Claims, 9 Drawing Sheets

U.S. PATENT DOCUMENTS 7,583,806 B2 * 9/2009 Holmi et al. ..... 381/86

FOREIGN PATENT DOCUMENTS

| | | | |
|---|---|---|---|
| JP | 1-223895 | A | 9/1989 |
| JP | 1-248800 | A | 10/1989 |
| JP | 2-222299 | A | 9/1990 |
| JP | 2-283540 | A | 11/1990 |
| JP | 3-239000 | | 10/1991 |
| JP | 10-336787 | A | 12/1998 |
| JP | 2003-47097 | A | 2/2003 |
| JP | 2003-143700 | A | 5/2003 |
| JP | 2006-295780 | A | 10/2010 |

OTHER PUBLICATIONS

JP Office Action for 2005-116844, Jun. 7, 2011.

Japanese language International Search Report for PCT/JP2006/307311, dated May 16, 2005.

* cited by examiner

SOUND REPRODUCING APPARATUS AND VEHICLE USING THE SOUND REPRODUCING APPARATUS

This application is a U.S. National Phase Application of PCT International Application PCT/JP2006/307311.

TECHNICAL FIELD

The present invention relates to a sound reproducing apparatus and a vehicle using the sound reproducing apparatus.

BACKGROUND ART

Conventionally, a sound reproducing apparatus and a vehicle using the same are as shown in FIG. 9.

In FIG. 9, phase shifter 2 is connected to music signal source 1, and the signal from music signal source 1 is phase-shifted by phase shifter 2. Power amplifier 3 is connected to phase shifter 2, and the output signal from phase shifter 2 is amplified by power amplifier 3. Output unit 4A is connected to power amplifier 3, and music or the like is outputted from output unit 4A. Power amplifier 5 is also connected to music signal source 1, and the output signal from music signal source 1 is amplified by power amplifier 5. Output unit 5 is connected to power amplifier 6A, and music or the like is outputted from output unit 6A.

As document information of prior art regarding this application, for example, Japanese Laid-Open Patent 2003-47097 is commonly known.

However, such a conventional sound reproducing apparatus involves a problem of sound quality.

That is, in the above conventional configuration, it is supposedly possible to prevent a specific frequency entering the right and left ears of the listener in vehicle 7 from being reversed in phase and muted. However, as shown in FIG. 9, when output unit 4B and output unit 6B are disposed at the rear seat side, sound wave interference that occurs in the front and rear direction of vehicle 7 cannot be prevented. Accordingly, it results in, for example, worsening of gain characteristic near 100 Hz at the rear seat.

DISCLOSURE OF THE INVENTION

A sound reproducing apparatus, comprising a sound signal source, a first power amplifier connected to the sound signal source, a first output unit connected to the first power amplifier, a first phase shifter connected to the sound signal source, a second power amplifier connected to the first phase shifter, a second output unit connected to the second power amplifier, a second phase shifter connected to the sound signal source, a third power amplifier connected to the second phase shifter, a third output unit connected to the third power amplifier, a third phase shifter connected to the sound signal source, a fourth phase shifter connected to the third phase shifter, a fourth power amplifier connected to the fourth phase shifter, and a fourth output unit connected to the fourth power amplifier, wherein the first output unit and the second output unit are in right and left relation with each other, the third output unit and the fourth output unit are in right and left relation with each other, and the group of the first output unit and second output unit and the group of the third output unit and fourth output unit are in front and back relation with each other.

A vehicle, comprising the sound reproducing apparatus.

DESCRIPTION OF THE REFERENCE NUMERALS AND SIGNS

8 Signal source
9A, 9AB First power amplifier
9B, 9BB Second power amplifier
9C, 9DB Third power amplifier
9D, 9CB Fourth power amplifier
9AA Fifth power amplifier
9BA Sixth power amplifier
9CA Seventh power amplifier
9DA Eighth power amplifier
10A, 10AB First output unit
10B, 10BB Second output unit
10AA Fifth output unit
10BA Sixth output unit
11A First phase shifter
11B Third phase shifter
11C Fifth phase shifter
11D Sixth phase shifter
12A, 12B, 18A, 18B, 18C, 18D, 12AA, 12BA Unit
13 Vehicle
14A, 14BA Second phase shifter
14B, 14AA Fourth phase shifter
14C Seventh phase shifter
14D Eighth phase shifter
15A, 15AB Third output unit
15B, 15BB Fourth output unit
15BA Seventh output unit
15AA Eighth output unit
16A Third filter
16B Fourth filter
16C Seventh filter

16D Eighth filter
17A First filter
17B Second filter
17C Fifth filter
17D Sixth filter
19A Ninth phase shifter
19B Tenth phase shifter
19C Eleventh phase shifter
19D Twelfth phase shifter
20A, 20B, 20C, 20D Delay filter

DETAILED DESCRIPTION OF THE PREFERRED EMBODIMENTS

The object of the present invention is to improve the sound quality in a sound reproducing apparatus and a vehicle equipped with the sound reproducing apparatus.

The sound reproducing apparatus of the present invention has two pairs of output units in front and rear which are given phase difference existing between the right and the left, and the two pairs of output units are further given phase difference. In this way, it is possible to reduce the worsening of gain characteristic due to sound wave interference that occurs in the front and rear direction of the vehicle. Accordingly, it brings about an effect of improving the sound quality.

Preferred Embodiment 1

A sound reproducing apparatus and a vehicle using the sound reproducing apparatus in the preferred embodiment 1 of the present invention will be described in the following with reference to the drawings.

Figure 1:
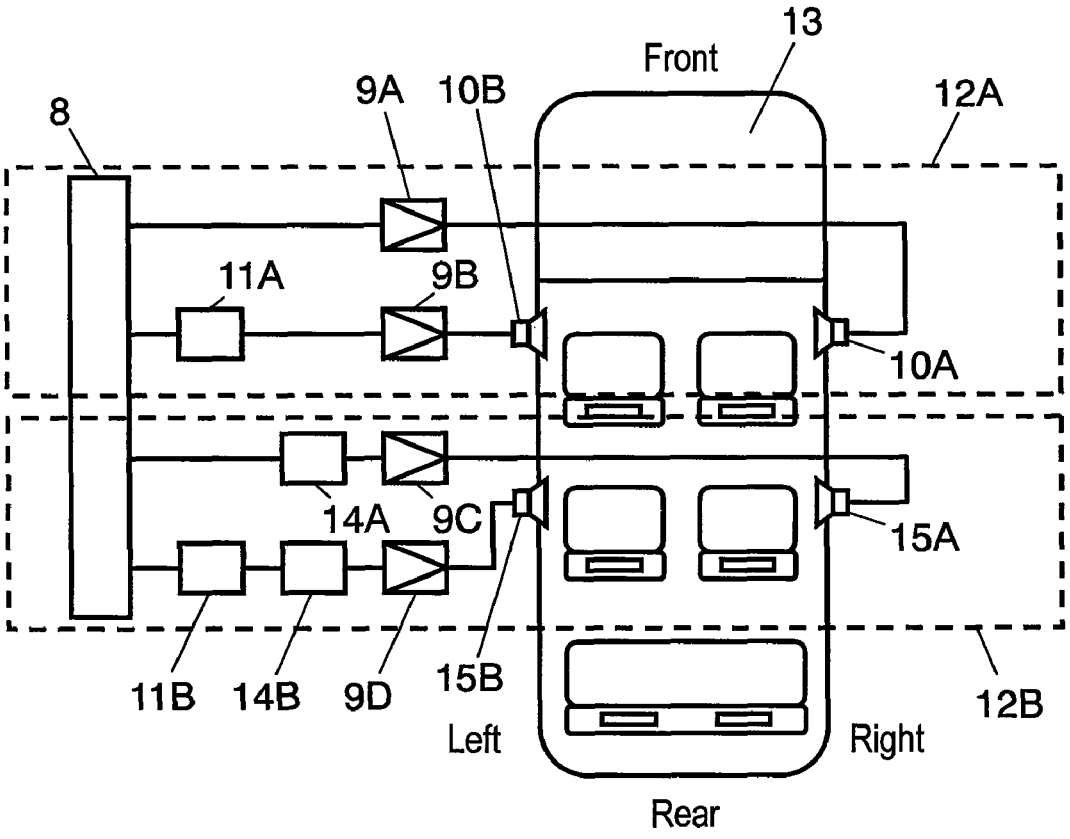
FIG. 1 is a block diagram of a sound reproducing apparatus and a vehicle using the sound reproducing apparatus in the preferred embodiment 1 of the present invention.

In the block diagram of FIG. 1, at the front seat side of vehicle 13, first power amplifier 9A is connected to signal source 8. First output unit 10A is connected to the first power amplifier 9A. Signal source 8 in the present invention is not limited to music. Also, vehicle 13 is for example an automobile, but the present invention is not limited to automobile. The signal outputted from signal source 8 is amplified by first power amplifier 9A and outputted from first output unit 10A. Also, first phase shifter 11A is connected to signal source 8. Second power amplifier 9B is connected to the first phase shifter 11A. Second output unit 10B is connected to the second power amplifier 9B. The signal outputted from signal source 8 is phase-shifted at first phase shifter 11A. The phase-shifted signal is amplified by second power amplifier 9B and outputted from second output unit 10B.

Unit 12A comprises the signal source 8, first power amplifier 9A, first output unit 10A, first phase shifter 11A, second power amplifier 9B, and second output unit 10B. In vehicle 13, the first output unit 10A and second output unit 10B are in right and left relation with each other, and the output from second output unit 10B is controlled by first phase shifter 11A. In this way, it is possible to reduce the worsening of sound quality due to sound wave interference that occurs in the right and left direction from first output unit 10A to second output unit 10B.

On the other hand, at the rear seat side of vehicle 13, second phase shifter 14A is connected to signal source 8, third power amplifier 9C is connected to the second phase shifter 14A, and third output unit 15A is connected to the third power amplifier 9C. The signal outputted from signal source 8 is phase-shifted by second phase-shifter 14A. The phase-shifted signal is amplified by third power amplifier 9C and outputted from third output unit 15A. Also, third phase shifter 11B is connected to signal source 8. Fourth phase shifter 14B is connected to third phase shifter 11B. Fourth power amplifier 9D is connected to the fourth phase shifter 14B. Fourth output unit 15B is connected to the fourth power amplifier 9D. The signal from signal source 8 is phase-shifted by third phase shifter 11B. The signal phase-shifted by third phase shifter 11B is further phase-shifted by fourth phase shifter 14B. The signal further phase-shifted by fourth phase shifter 14B is amplified by fourth poser amplifier 9D and outputted from fourth output unit 15B.

Unit 12B comprises the signal source 8, second phase shifter 14A, third power amplifier 9C, third output unit 15A, third phase shifter 11B, fourth phase shifter 14B, fourth power amplifier 9D, and fourth output unit 15B. In vehicle 13, the third output unit 15A and fourth output unit 15B are in right and left relation with each other. The output from fourth output unit 15B is phase-controlled by third phase shifter 11B, and thereby, it is possible to reduce the worsening of sound quality due to sound wave interference that occurs in the right and left direction from third output unit 15A to fourth output unit 15B.

Further, in the configuration having unit 12A and unit 12B, a group of first output unit 10A and second output unit 10B in vehicle 13 and a group of third output unit 15A and fourth output unit 15B are in front and rear relation with each other. The outputs from third output unit 15A and fourth output unit 15B are respectively phase-controlled by second phase shifter 14A and fourth phase shifter 14B, and thereby, it is possible to reduce the worsening of sound quality due to sound wave interference that occurs in the front and rear direction of the vehicle.

As the phase shifter 11A, third phase shifter 11B, second phase shifter 14A, and fourth phase shifter 14B, for example, secondary phase shifters are used. Similar effects can be obtained by using those of secondary or higher order.

It is preferable to reverse the order in which third phase shifter 11B and fourth phase shifter 14B are connected.

Also, in this preferred embodiment, fourth phase shifter 14B is connected to third phase shifter 11B. However, it is preferable to connect the fourth phase shifter 14B to first phase shifter 11A, eliminating third phase shifter 11B.

Figure 2:
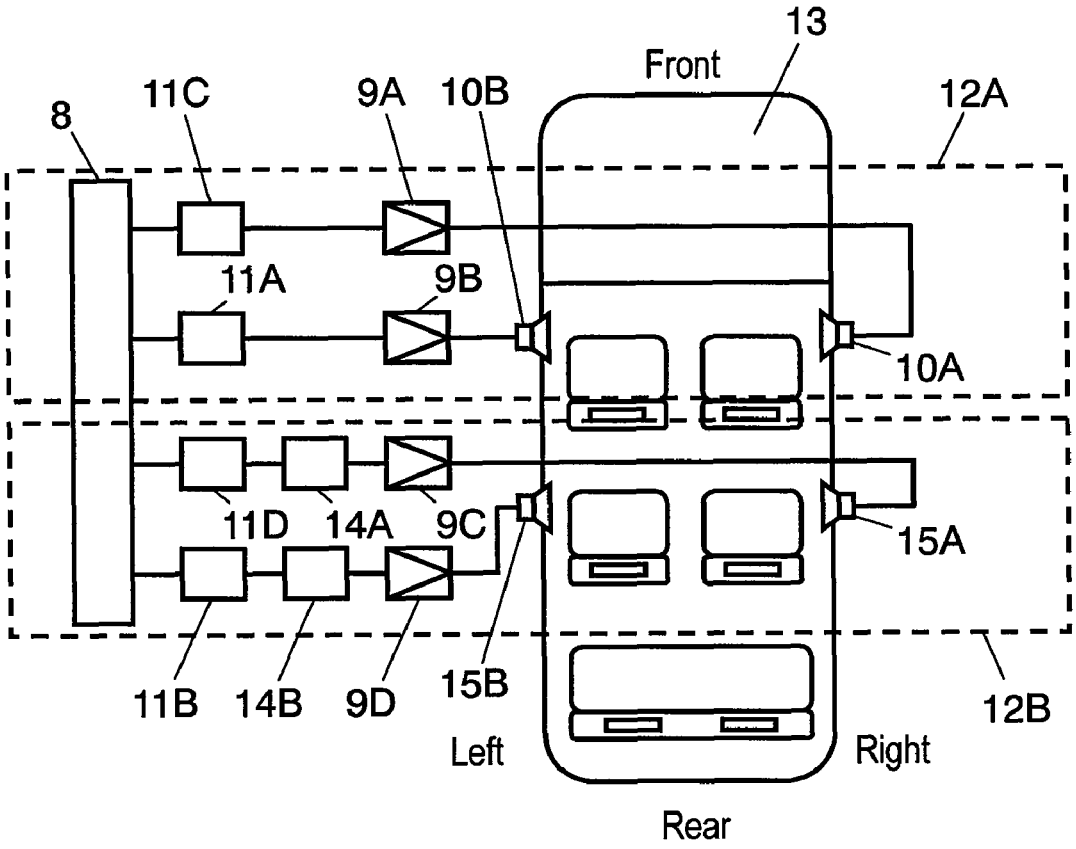
FIG. 2 is a block diagram of another sound reproducing apparatus and a vehicle using the sound reproducing apparatus in the preferred embodiment 1 of the present invention.

FIG. 2 shows another example of configuration in this preferred embodiment. In the configuration of FIG. 2, fifth phase shifter 11C and sixth phase shifter 11D are added to the configuration of FIG. 1. FIG. 2 is explained in the following mainly about the differences from FIG. 1. As shown in FIG. 2, fifth phase shifter 11C different in phase rotation center frequency from first phase shifter 11A is disposed between signal source 8 and first power amplifier 9A. Also, sixth phase shifter 11D different in phase rotation center frequency from third phase shifter 11B is disposed between signal source 8 and third power amplifier 9C. In this way, sound quality deterioration due to sound wave interference that occurs in the right and left direction of vehicle 13 can be reduced over a broad band between first output unit 10A and second output unit 10B, and between third output unit 15A and fourth output unit 15B.

It is preferable to reverse the order in which sixth phase shifter 11D and second phase shifter 14A are connected.

Figure 3:
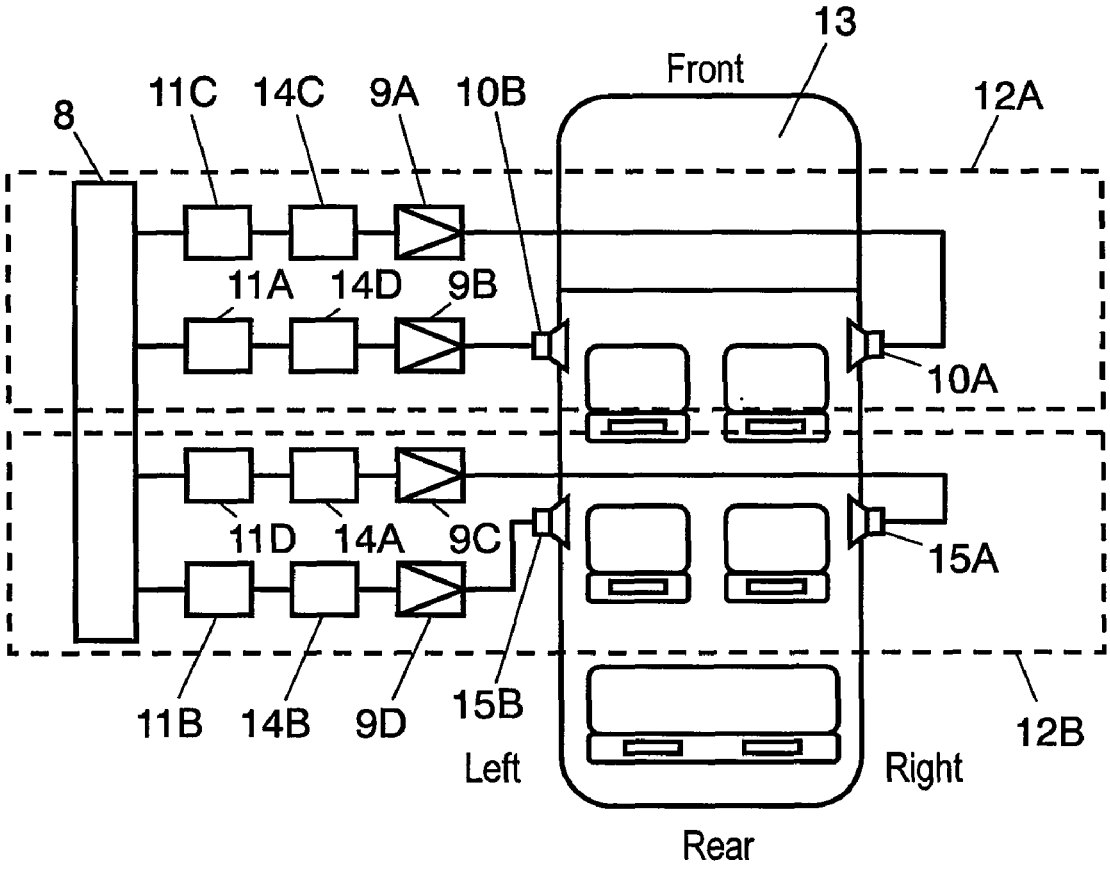
FIG. 3 is a block diagram of still another sound reproducing apparatus and a vehicle using the sound reproducing apparatus in the preferred embodiment 1 of the present invention.

FIG. 3 shows further another example of configuration in this preferred embodiment. In the configuration of FIG. 3, seventh phase shifter 14C and eighth phase shifter 14D are added to the configuration of FIG. 2. FIG. 3 is explained in the following mainly about the differences from FIG. 2. As shown in FIG. 3, seventh phase shifter 14C different in phase rotation center frequency from second phase shifter 14A is disposed between signal source 8 and first power amplifier 9A. Also, eighth phase shifter 14D different in phase rotation center frequency from fourth phase shifter 14B is disposed between signal source 8 and second power amplifier 9B. In this way, sound quality deterioration due to sound wave interference that occurs in the front and rear direction of vehicle 13 can be reduced over a broad band.

The preferred embodiment 1 of the present invention has been described above with reference to the drawings. In this preferred embodiment, there is provided a controller (not shown) for controlling the characteristic of each phase shifter and the characteristic of each filter, and it is possible to control each phase shifter and filter to the desired characteristic by means of the controller. As a result of this control, the sound quality can be further optimized or the sound quality can be freely adjusted according to the listener's liking. The controller can be installed so as to be operated by the driver of vehicle 13, and it can also be installed so as to be operated by the person at each seat of the vehicle.

Preferred Embodiment 2

A sound reproducing apparatus and a vehicle using the sound reproducing apparatus in the preferred embodiment 2 of the present invention will be described in the following with reference to the drawings.

Those having same configuration as that of the preferred embodiment 1 are given same reference numerals and the description is omitted.

Figure 4:
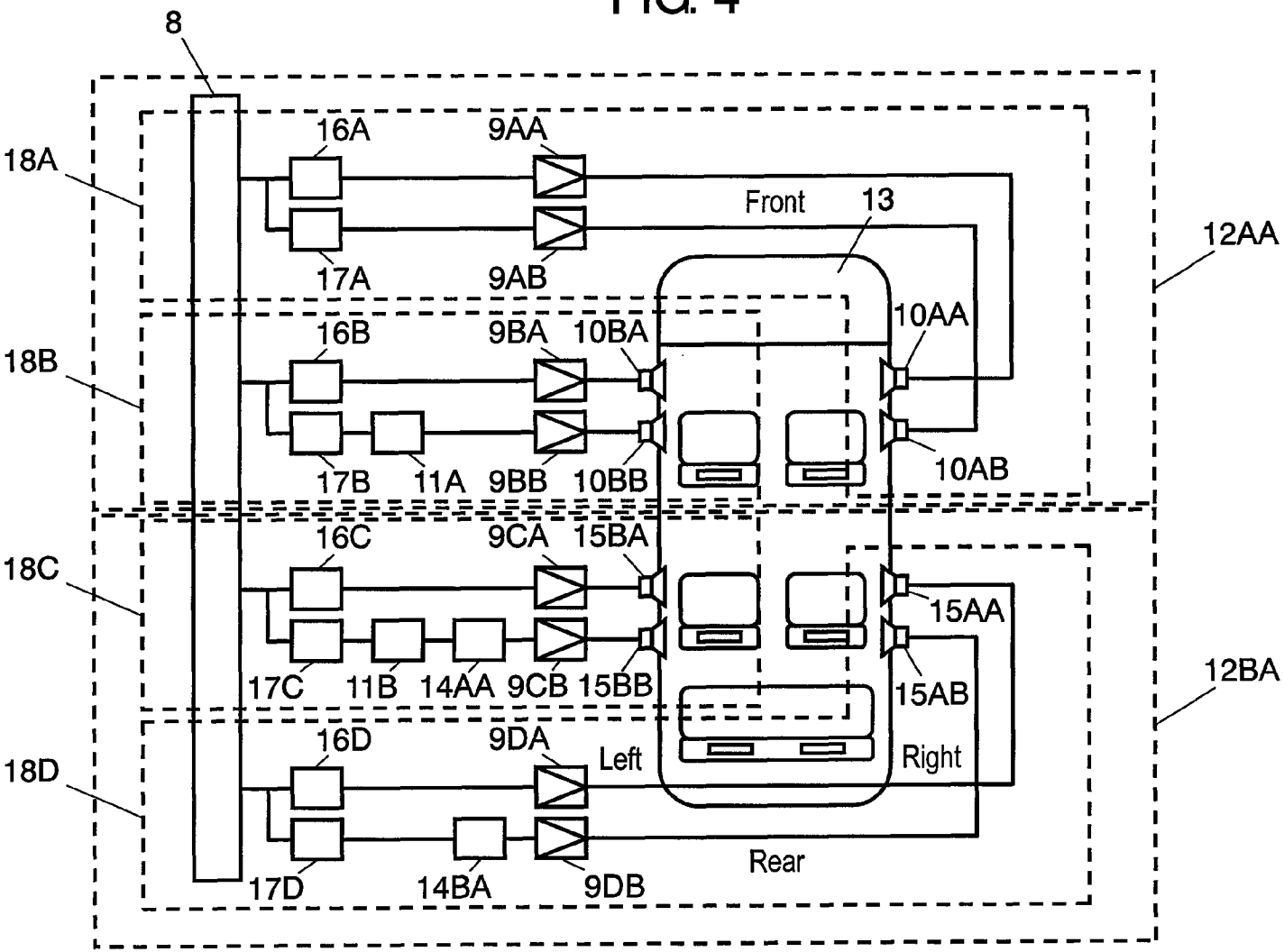
FIG. 4 is a block diagram of a sound reproducing apparatus and a vehicle using the sound reproducing apparatus in the preferred embodiment 2 of the present invention.

FIG. 4 shows a sound reproducing apparatus and a vehicle using the sound reproducing apparatus in the preferred embodiment 2. In the block diagram of FIG. 2, third filter 16A and first filter 17A are connected to signal source 8. Fifth power amplifier 9AA is connected to third filter 16A, and fifth output unit 10AA is connected to fifth power amplifier 9AA. First power amplifier 9AB is connected to first filter 17A, and first output unit 10AB is connected to first power amplifier 9AB.

First filter 17A is for example a low-pass filter, and third filter 16A is for example a high-pass filter. When first filter 17A is a low-pass filter, and third filter 16A is a high-pass filter, then the signal from signal source 8 is attenuated for low-pass frequency component by third filter 16A, and high-pass frequency component is supplied to fifth power amplifier 9AA. On the other hand, the signal from signal source 8 is attenuated for high-pass frequency component by first filter 17A, and low-pass frequency component is supplied to first power amplifier 9AB. The cut-off frequency of first filter 17A and the cut-off frequency of third filter 16A are for example set to nearly same frequency.

Unit 18A comprises signal source 8, third filter 16A, first filter 17A, fifth power amplifier 9AA, fifth output unit 10AA, first power amplifier 9AB, and first output unit 10AB.

Also, fourth filter 16B and second filter 17B are connected to signal source 8. Sixth power amplifier 9BA is connected to fourth filter 16B, and sixth output unit 10BA is connected to sixth power amplifier 9BA. First phase shifter 11A is connected to second filter 17B, second power amplifier 9BB is connected to first phase shifter 11A, and second output unit 10BB is connected to second power amplifier 9BB.

Second filter 17B is for example a low-pass filter, and fourth filter 16B is for example a high-pass filter. When second filter 17B is a low-pass filter, and fourth filter 16B is a high-pass filter, then the signal from signal source 8 is attenuated for low-pass frequency component by fourth filter 16B, and high-pass frequency component is supplied to sixth power amplifier 9BA. On the other hand, the signal from signal source 8 is attenuated for high-pass frequency component by second filter 17B, and low-pass frequency component is supplied to first phase shifter 11A. The cut-off frequency of fourth filter 16B and the cut-off frequency of second filter 17B are for example set to nearly same frequency.

Unit 18B comprises signal source 8, fourth filter 16B, second filter 17B, sixth power amplifier 9BA, sixth output unit 10BA, first phase shifter 11A, second power amplifier 9BB, and second output unit 10BB.

Further, seventh filter 16C and fifth filter 17C are connected to signal source 8. Seventh power amplifier 9CA is connected to seventh filter 16C, and seventh output unit 15BA is connected to seventh power amplifier 9CA. Third phase shifter 11B is connected to fifth filter 17C, and fourth phase shifter 14AA is connected to third phase shifter 11B. Fourth power amplifier 9CB is connected to fourth phase shifter 14AA, and fourth output unit 15BB is connected to fourth power amplifier 9CB.

Fifth filter 17C is for example a low-pass filter, and seventh filter 16C is for example a high-pass filter. When fifth filter 17C is a low-pass filter, and seventh filter 16C is a high-pass filter, then the signal from signal source 8 is attenuated for low-pass frequency component by seventh filter 16C, and high-pass frequency component is supplied to seventh power amplifier 9CA. On the other hand, the signal from signal source 8 is attenuated for high-pass frequency component by fifth filter 17C, and low-pass frequency component is supplied to third phase shifter 11B. The cut-off frequency of seventh filter 16C and the cut-off frequency of fifth filter 17C are for example set to nearly same frequency.

Unit 18C comprises signal source 8, seventh filter 16C, fifth filter 17C, seventh power amplifier 9CA, seventh output unit 15BA, third phase shifter 11B, fourth phase shifter 14AA, fourth power amplifier 9CB, and fourth output unit 15BB.

And, eighth filter 16D and sixth filter 17D are connected to signal source 8. Eighth power amplifier 9DA is connected to eighth filter 16D, and eighth output unit 15AA is connected to eighth power amplifier 9DA. Second phase shifter 14BA is connected to sixth filter 17D, third power amplifier 9DB is connected to second phase shifter 14BA, and third output unit 15AB is connected to third power amplifier 9DB.

Sixth filter 17D is for example a low-pass filter, and eighth filter 16*d* is for example a high-pass filter. When sixth filter 17D is a low-pass filter, and eighth filter 16D is a high-pass filter, then the signal from signal source 8 is attenuated for low-pass frequency component by eighth filter 16D, and high-pass frequency component is supplied to eighth power amplifier 9DA. On the other hand, the signal from signal source 8 is attenuated for high-pass frequency component by sixth filter 17D, and low-pass frequency component is supplied to second phase shifter 14BA. The cut-off frequency of eighth filter 16D and the cut-off frequency of sixth filter 17D are for example set to nearly same frequency.

Unit 18D comprises signal source 8, eighth filter 16D, sixth filter 17D, eighth power amplifier 9DA, eighth output unit 15AA, second phase shifter 14BA, third power amplifier 9DB, and third output unit 15AB.

Unit 12AA is formed of unit 18A and unit 18B, and unit 12BA is formed of unit 18C and unit 18D.

It is preferable to reverse the order in which third phase shifter 11B and fourth phase shifter 14AA are connected.

In the above configuration, first phase shifter 11A, third phase shifter 11B, fourth phase shifter 14AA, and second phase shifter 14BA are not disposed at third filter 16A, fourth filter 16B, seventh filter 16C, and eighth filter 16D. First phase shifter 11A, third phase shifter 11B, fourth phase shifter 14AA, and second phase shifter 14BA are disposed only at first filter 17A, second filter 17B, fifth filter 17C, and sixth filter 17D of which stationary waves give great influence to the ears. In this way, it is possible to efficiently reduce the worsening of sound quality due to low-frequency sound wave interference that occurs in all directions. In addition, when there exists a negative-phase frequency only at the low frequency side, it is possible to obtain higher sound quality because of including no modification of high-frequency sound.

Figure 5:
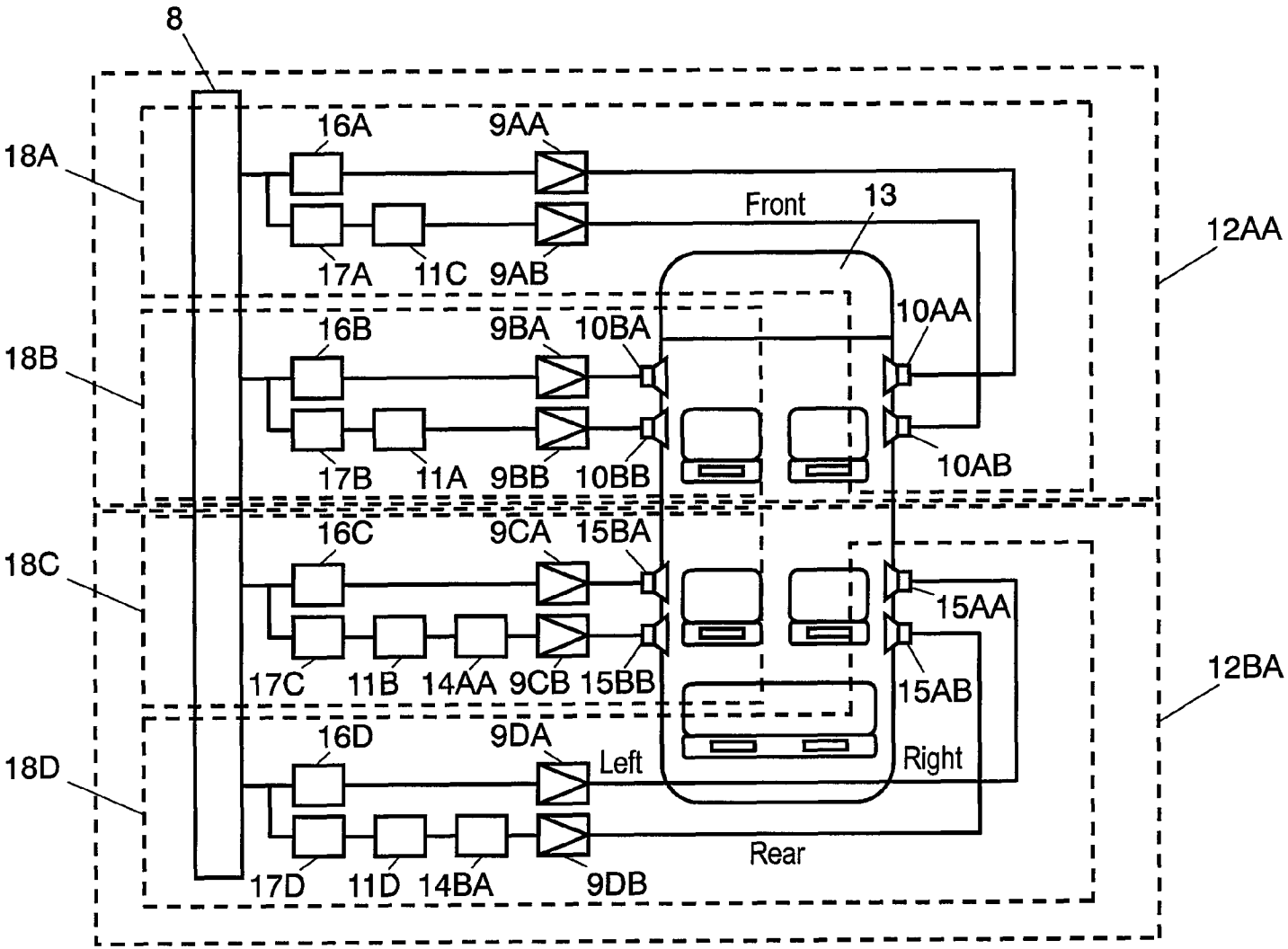
FIG. 5 is a block diagram of another sound reproducing apparatus and a vehicle using the sound reproducing apparatus in the preferred embodiment 2 of the present invention.

FIG. 5 shows an example of another configuration in this preferred embodiment. FIG. 5 is explained in the following mainly about the difference from FIG. 4. In the configuration of FIG. 5, fifth phase shifter 11C and sixth phase shifter 11D are added to the configuration of FIG. 4. As shown in FIG. 5, fifth phase shifter 11C different in phase rotation center frequency from first phase shifter 11A is disposed between first filter 17A and first power amplifier 9AB, and sixth phase shifter 11D different in phase rotation center frequency from third phase shifter 11B is disposed between sixth filter 17D and third power amplifier 9DB. In this way, the sound quality deterioration due to sound wave interference that occurs in the right and left direction of vehicle 13 can be reduced over a broad band between the group of fifth output unit 10AA and first output unit 10AB and the group of sixth output unit 10BA and second output unit 10BB. Similarly, the sound quality deterioration due to sound wave interference that occurs in the right and left direction of vehicle 13 can be reduced over a broad band between the group of eighth output unit 15AA and third output unit 15AB and the group of seventh output unit 15BA and fourth output unit 15BB.

It is preferable to reverse the order in which sixth phase shifter 11D and second phase shifter 14BA are connected.

Figure 6:
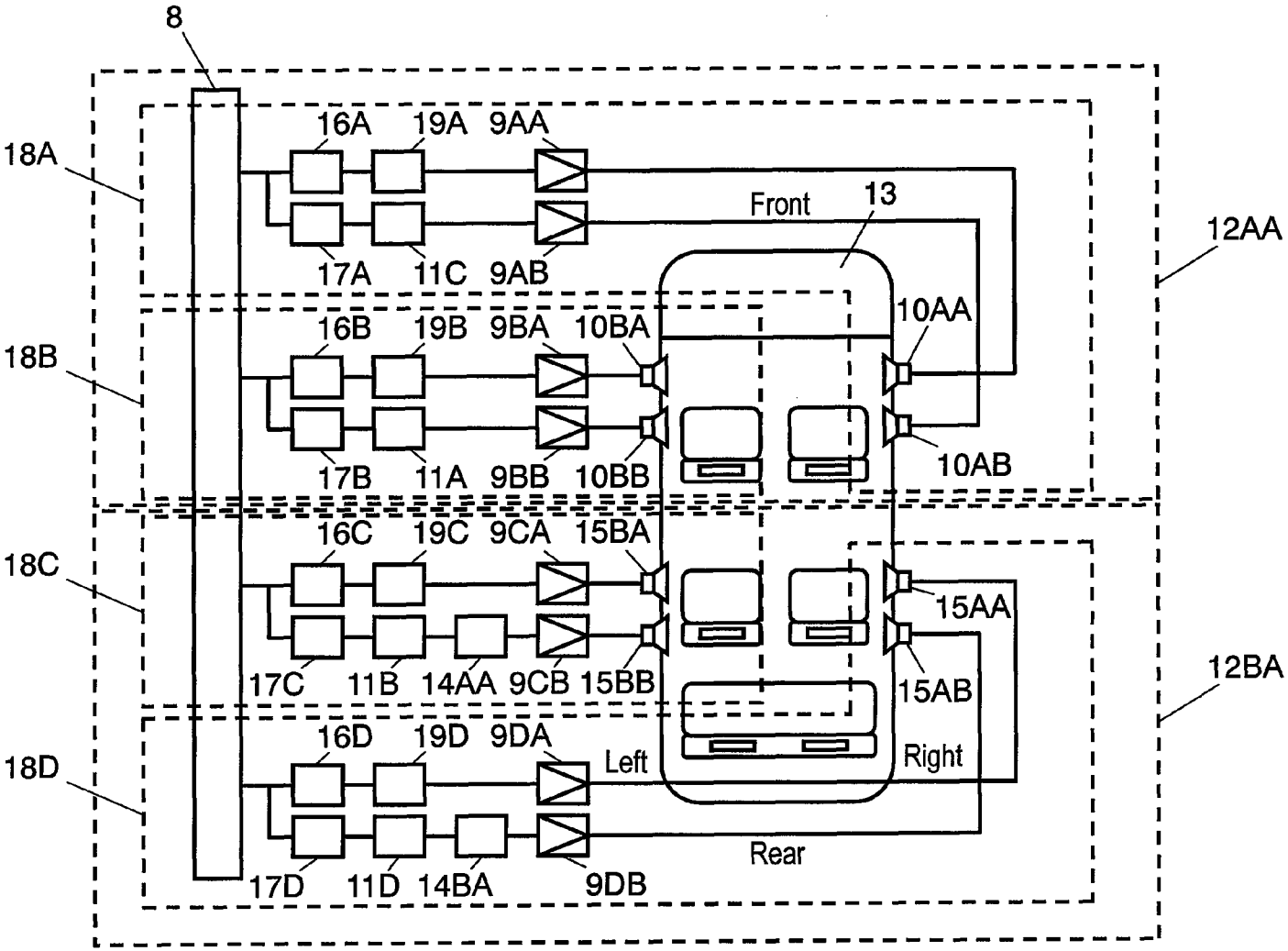
FIG. 6 is a block diagram of still another sound reproducing apparatus and a vehicle using the sound reproducing apparatus in the preferred embodiment 2 of the present invention.

FIG. 6 shows an example of further another configuration in this preferred embodiment. FIG. 6 is explained in the following mainly about the difference from FIG. 5. In the configuration of FIG. 6, ninth phase shifter 19A is disposed between third filter 16A and fifth power amplifier 9AA. And, tenth phase shifter 19B different in phase rotation center frequency from ninth phase shifter 19A is disposed between fourth filter 16B and sixth power amplifier 9BA. In this way, modification can be realized with high frequency component separated from low frequency component.

Similarly, eleventh phase shifter 19C is disposed between seventh filter 16C and seventh power amplifier 9CA. And, twelfth phase shifter 19D different in phase rotation center frequency from eleventh phase shifter 19C is disposed between eighth filter 16D and eighth power amplifier 9DA. In this way, modification can be realized with high frequency component separated from low frequency component.

Figure 7:
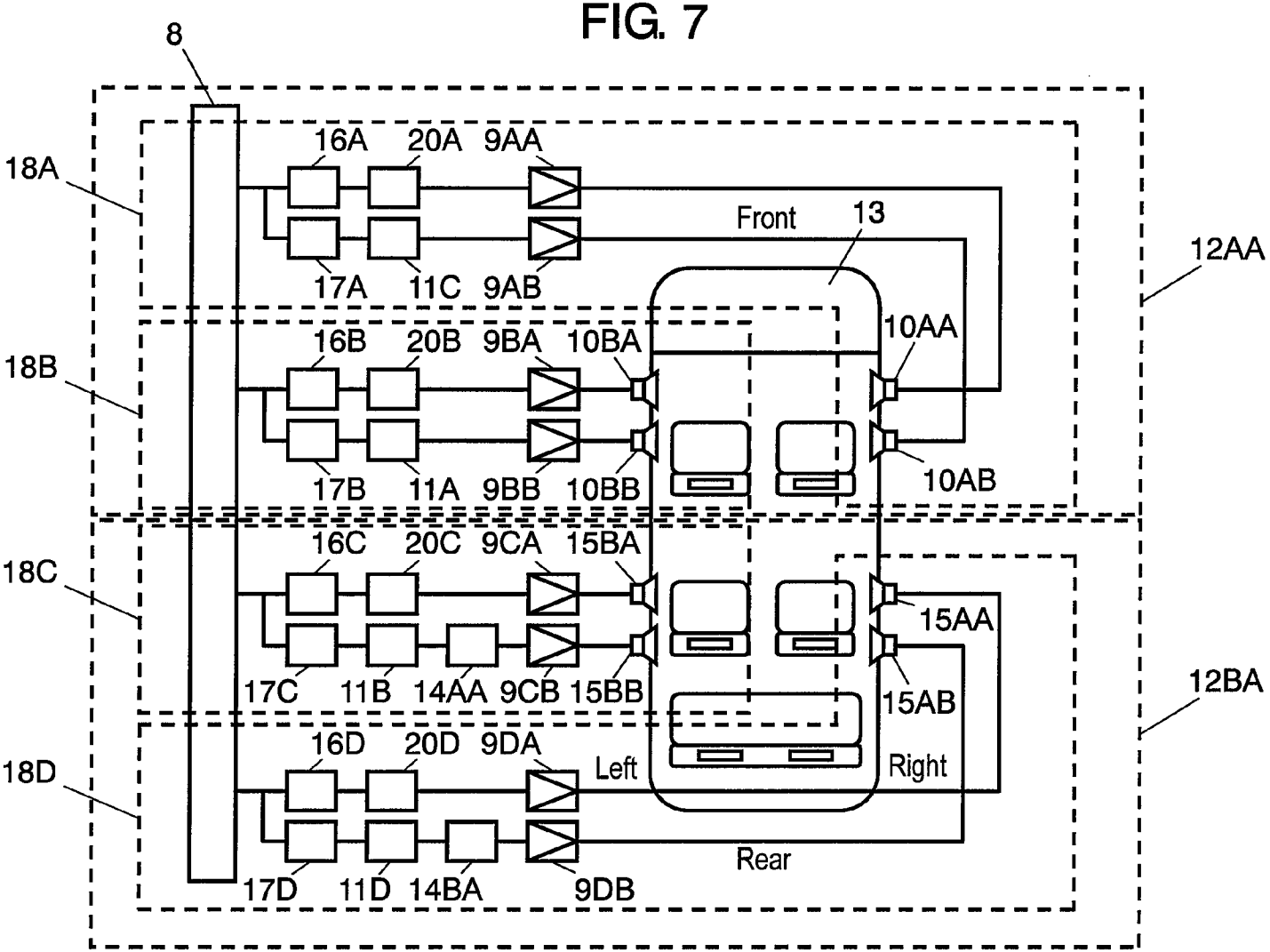
FIG. 7 is a block diagram of further another sound reproducing apparatus and a vehicle using the sound reproducing apparatus in the preferred embodiment 2 of the present invention.

FIG. 7 is an example of further another configuration in this preferred embodiment. FIG. 7 is explained in the following mainly about the difference from FIG. 6. As shown in FIG. 7, in place of ninth phase shifter 19A, tenth phase shifter 19B, eleventh phase shifter 19C, and twelfth phase shifter 19D in FIG. 6, delay filter 20A is disposed between high-pass filter 16A and fifth power amplifier 9AA, and delay filter 20B is disposed between fourth filter 16B and sixth power amplifier 9BA, and delay filter 20C is disposed between seventh filter 16C and seventh power amplifier 9CA, and delay filter 20D is disposed between eighth filter 16D and eighth power amplifier 9DA. In this way, it is possible to cope with the high frequency side where the cycle is short and the phase is greatly modulated.

Figure 8:
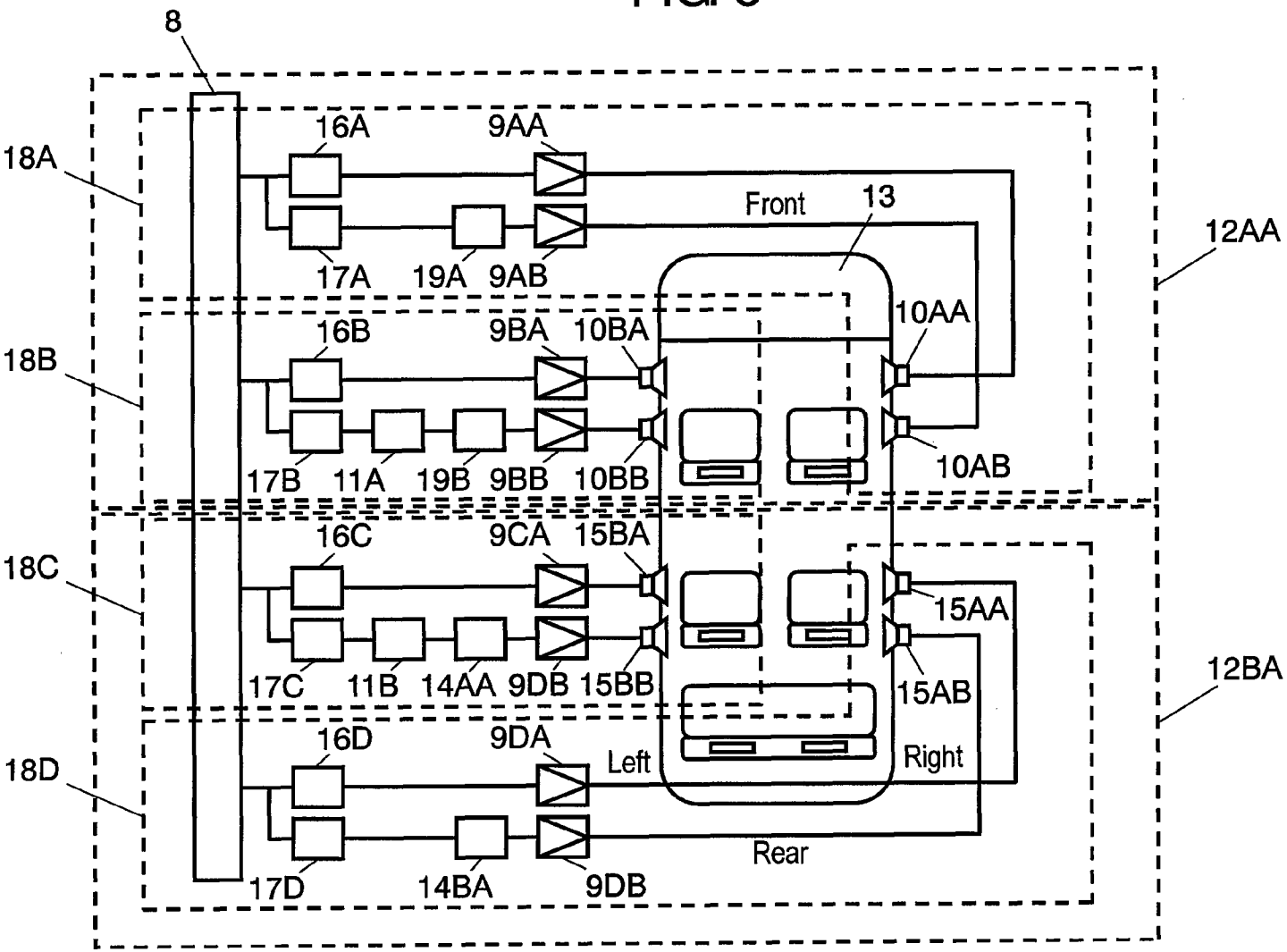
FIG. 8 is a block diagram of further another sound reproducing apparatus and a vehicle using the sound reproducing apparatus in the preferred embodiment 2 of the present invention.
Figure 9:
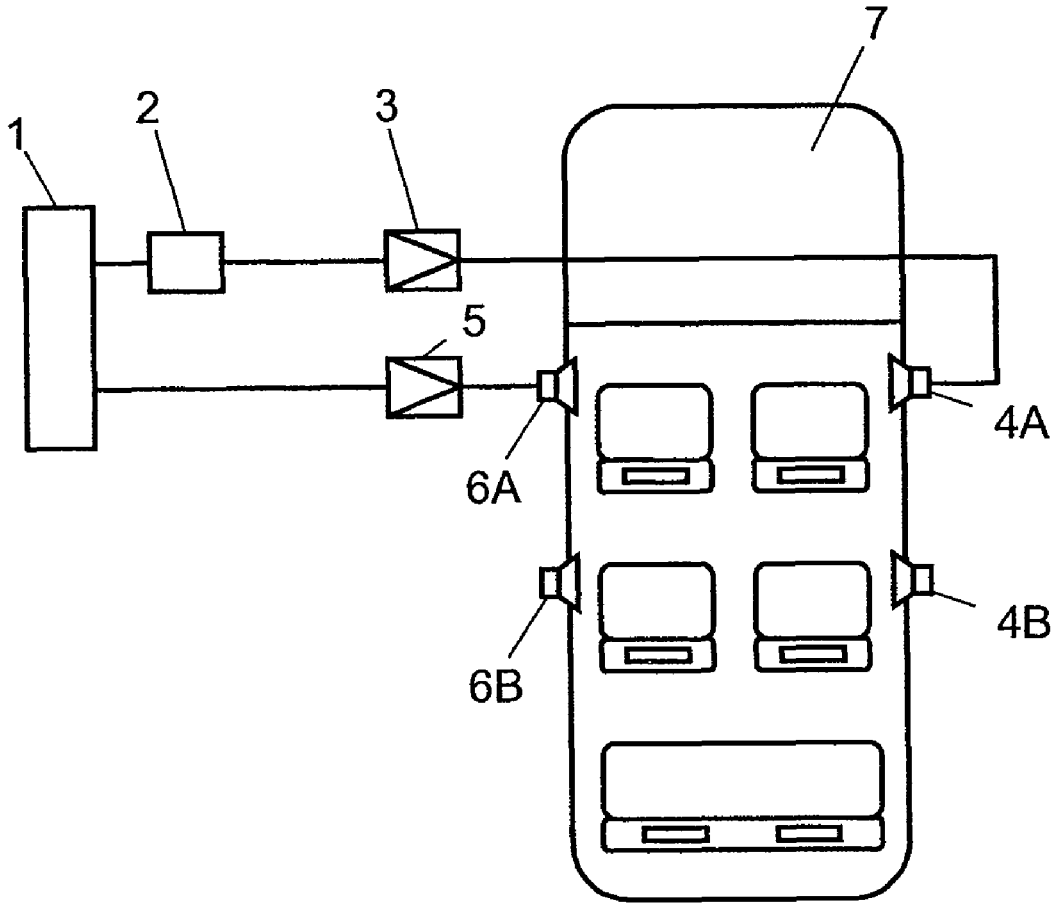
FIG. 9 PRIOR ART
FIG. 9 is a configuration diagram showing a conventional sound reproducing apparatus and a vehicle using the sound reproducing apparatus.

FIG. 8 shows an example of further another configuration in this preferred embodiment. FIG. 8 is explained in the following mainly about the difference from FIG. 4. In the configuration of FIG. 8, ninth phase shifter 19A different in phase rotation center frequency from second phase shifter 14BA is disposed between first filter 17A and first power amplifier 9AB. And, tenth phase shifter 19B different in phase rotation center frequency from fourth phase shifter 14AA is disposed between second filter 17B and second power amplifier 9BB. In this way, the sound deterioration due to sound wave interference that occurs in the front and rear direction of vehicle 13 can be reduced over a broad band.

It is preferable to reverse the order in which first phase shifter 11A and tenth phase shifter 19B are connected.

The preferred embodiment 1 of the present invention has been described with reference to the drawings. In this preferred embodiment, there is provided a controller (not shown) for controlling the characteristics of each phase shifter, each filter, and each delay filter, and it is possible to control each phase shifter, each filter and each delay filter to the desired characteristics by means of the controller. As a result of this control, the sound quality can be further optimized or the sound quality can be freely adjusted according to the user's liking. It is possible to install the controller in such position that it can be operated by the driver of vehicle 13, and can also be installed in such position that it can be operated by any person at each seat of the vehicle.

INDUSTRIAL APPLICABILITY

The sound reproducing apparatus of the present invention is able to reduce the sound quality deterioration due to sound wave interference that occurs in the front and rear direction, which is therefore effective to improve the sound quality and useful in various sound reproducing apparatuses installed in vehicles such as automobiles.

The invention claimed is:

1. A sound reproducing apparatus for use with a sound signal source, said sound reproducing apparatus comprising:

a first unit including:

a first power amplifier connected to the sound signal source;

a first speaker connected to the first power amplifier;

a first phase shifter connected to the sound signal source;

a second power amplifier connected to the first phase shifter;

a second speaker connected to the second power amplifier, wherein the first phase shifter phase-shifts the sound signal source to reduce interference between output signals of the first speaker and the second speaker; and a second unit including:

a second phase shifter connected to the sound signal source;

a third power amplifier connected to the second phase shifter;

a third speaker connected to the third power amplifier;

a third phase shifter connected to the sound signal source;

a fourth phase shifter connected to the third phase shifter;

a fourth power amplifier connected to the fourth phase shifter; and a fourth speaker connected to the fourth power amplifier, wherein the third phase shifter phase-shifts the sound signal source to reduce interference between output signals of the third speaker and the fourth speaker, wherein the first speaker and the second speaker are in right and left relation with each other with respect to an area;

the third speaker and the fourth speaker are in right and left relation with each other with respect to the area;

a first group of the first speaker and the second speaker is positioned in a front of the area and a second group of the third speaker and the fourth speaker is positioned in a rear of the area; and the second phase shifter and the fourth phase shifter phase-shift the sound signal source to reduce interference between output signals of the first group of the first speaker and the second speaker and output signals of the second group of the third speaker and the fourth speaker.

2. A vehicle using the sound reproducing apparatus of claim 1.

3. The sound reproducing apparatus according to claim 1, wherein the first unit further includes a fifth phase shifter connected in series between the sound signal source and the first power amplifier, wherein the second unit further includes a sixth phase shifter connected in series to the second phase shifter and between the sound signal source and the third power amplifier, wherein the fifth phase shifter is different in a phase rotation center frequency from the first phase shifter, and wherein the sixth phase shifter is different in a phase rotation center frequency from the third phase shifter.

4. The sound reproducing apparatus according to claim 3, wherein the first unit further includes:

a seventh phase shifter connected in series to the fifth phase shifter and between the sound signal source and the first power amplifier; and an eighth phase shifter connected in series to the second phase shifter and between the sound signal source and the second power amplifier, wherein the seventh phase shifter is different in a phase rotation center frequency from the second phase shifter, and wherein the eighth phase shifter is different in a phase rotation center frequency from the fourth phase shifter.

* * * * *